United States Patent [19]

Slattery

[11] Patent Number: 4,534,739

[45] Date of Patent: Aug. 13, 1985

[54] RECOIL STARTER LOCK AND NEUTRAL GEAR THROTTLE LIMIT FOR MARINE DRIVES

[75] Inventor: Gordon C. Slattery, Omro, Wis.

[73] Assignee: Brunswick Corp., Skokie, Ill.

[21] Appl. No.: 564,882

[22] Filed: Dec. 23, 1983

[51] Int. Cl.[3] ..... F02N 17/00

[52] U.S. Cl. ..... 440/84; 74/480 B; 74/850

[58] Field of Search ..... 440/84, 85, 86, 87, 440/75; 123/413; 74/480 B, 850, 872

[56] References Cited

U.S. PATENT DOCUMENTS

| | | | |
|---|---|---|---|
| 2,635,576 | 4/1953 | Kiekhaefer | 440/87 |
| 2,867,131 | 1/1959 | Schroeder | 74/850 |
| 2,867,132 | 1/1959 | Schroeder | 440/86 |
| 3,317,012 | 5/1967 | Heidner | 74/477 |
| 3,782,350 | 1/1974 | McBride | 74/850 |
| 4,439,163 | 3/1984 | Burmeister | 440/75 |

*Primary Examiner*—Trygve M. Blix
*Assistant Examiner*—C. T. Bartz
*Attorney, Agent, or Firm*—Andrus, Sceales, Starke & Sawall

[57] ABSTRACT

A recoil starter lock and neutral throttle limit is suitable for use in a marine drive having a rotatable shaft operable between neutral and drive positions, a movable throttle control for opening and closing the throttle valve and a recoil starter lock. A cam is mounted on the shaft for movement by rotation of the shaft as the operator shifts gears. A recoil starter lock actuating member coacts with the cam and is pivotally movable by the movement of the cam as the latter moves between the neutral and drive positions. The actuator member is coupled to the recoil starter lock for releasing the lock when the gear shift is in neutral. The actuating member has a stop engaging a stop on the throttle lever when the shaft is in the neutral position that limits the amount by which the throttle control may be moved and the throttle valve of the motor may be opened. The actuating member is preferably L-shaped with one of the arms being connected to the recoil starter lock and the other of the arms having a rise and fall configuration by which movement of the cam may move the actuating member.

5 Claims, 3 Drawing Figures

RECOIL STARTER LOCK AND NEUTRAL GEAR THROTTLE LIMIT FOR MARINE DRIVES

The present invention relates to an improved recoil starter lock and neutral gear throttle limit for marine drives.

In marine drives, such as an outboard motor, having a recoil starter and forward, neutral, and reverse gears, it is desirable to provide an interlock between the gear shifting elements and the starter so that the starter can be operated only when the motor is in neutral. This facilitates, starting since the starter need not rotate the propeller and other drive portions of the motor. Unexpected or undesired movement of the boat during motor starting is avoided.

Further, it is also desirable to provide a throttle limit when the motor is in neutral to avoid overspeeding the motor when it is unloaded.

To date, mechanisms for obtaining these operations have been characterized by considerable complexity. This has rendered them expensive to manufacture and has hampered their reliability and ease of repair.

It is, therefore, the object of the present invention to provide an improved means for obtaining starter-gear shift interlock and neutral gear throttle limit in a marine drive. The means is suitable for use in a marine drive having a rotatable shaft operable between neutral and drive positions, a movable throttle lever for opening and closing the throttle valve and a recoil starter lock. A cam is mounted on the shaft for movement by rotation of the shaft as the operator shifts gears. A recoil starter lock actuating member coacts with the cam and is pivotally movable by the movement of the cam as the latter moves between the neutral and drive positions. The actuator member is coupled to the recoil starter lock for releasing the lock when the gear shift is in neutral. The actuating member has a stop engaging a stop on the throttle lever, when the shaft is in the neutral position, that limits the amount by which the throttle lever may be moved and the throttle valve of the motor may be opened. The actuating member is preferably L-shaped with one of the arms being connected to the recoil starter lock and the other of the arms having the throttle lever stop and a rise and fall configuration by which movement of the cam may move the actuating member.

Figure 1:
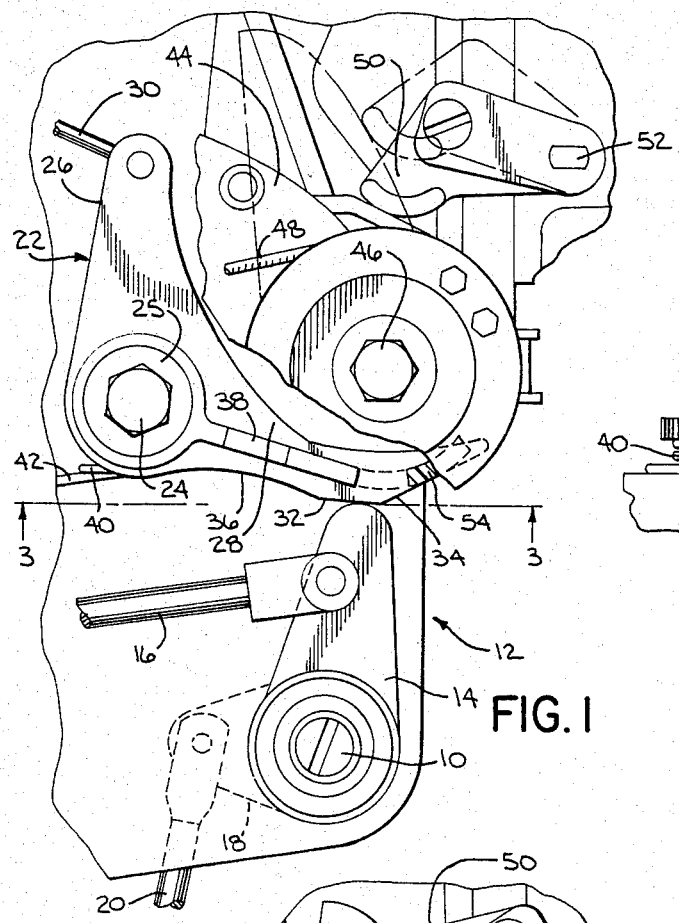
Figure 3:
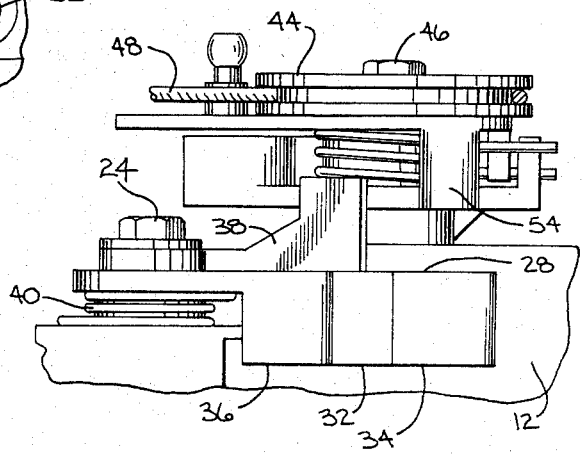
Figure 2:
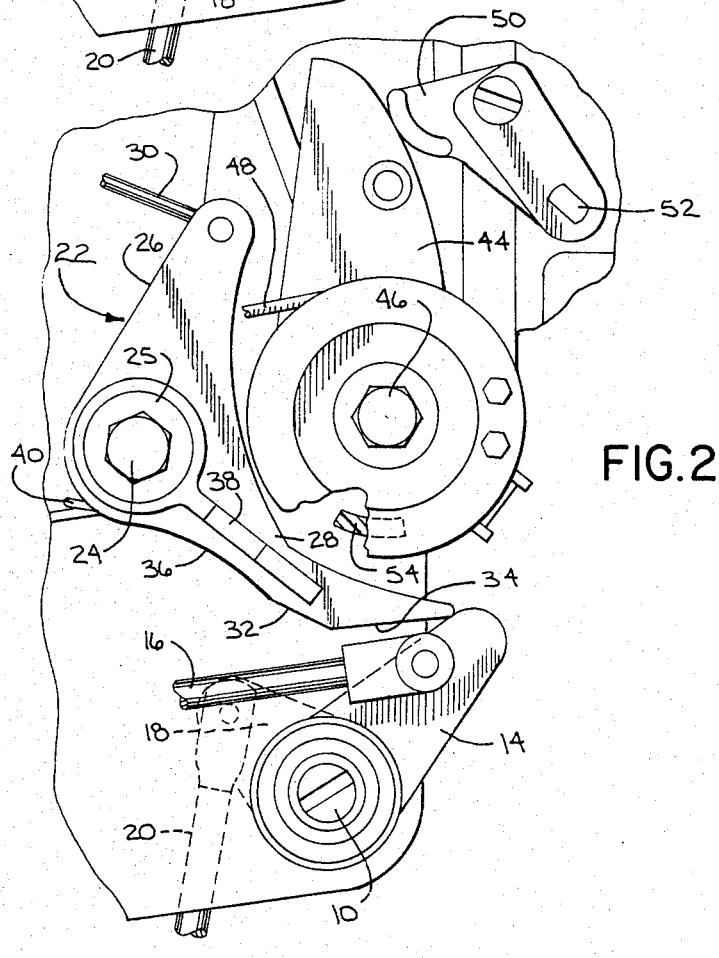

The invention will be understood by reference to the following detailed description and accompanying drawings in which:

FIG. 1 is a fragmentary side view of a marine drive showing the improved device of the present invention in one operative condition; and FIG. 2 is a fragmentary side view, similar to FIG. 1, showing the improved device of the present invention in another operative condition; and FIG. 3 is a view taken along the line 3—3 of FIG. 1.

In FIG. 1, the numeral 10 indicates an operator controlled gear shifting shaft of a marine drive, such as outboard motor 12. Shaft 10 is rotatable to select the forward, reverse, or neutral gear for outboard motor 12. Cam 14 is mounted on the end of shaft 10. In the outboard motor 12 shown in FIG. 1, shaft 10 is rotated by rod 16 connected to the helm of the boat and to cam 14. However, it will be appreciated that shaft 10 could also contain a handle outside the cowl of motor 12 by which the shaft could be rotated. Shaft 10 includes crank 18 for operating shift shaft 20 connected to the gear box of the motor.

Recoil starter lock actuator 22 is pivotally mounted on motor 12 by bolt 24, that may contain an appropriate bushing, and washer 25. Recoil starter lock actuator 22 has a pair of arms 26, 28 formed in a generally L-shaped configuration. Bolt 24 extends through recoil starter lock actuator 22 at the junction of arms 26 and 28. Link rod 30 has one end fastened to arm 26. The other end of link rod 30 extends to the recoil starter to operate the lock.

Arm 28 includes cam rise 32 with cam fall 34 on one side of the rise and cam fall 36 on the other. As shown in the figures, arm 28 extends generally horizontally to coact with cam 14. Arm 28 has a flange-like stop member 38 formed on the side away from motor 12 as seen most clearly in FIG. 3.

Actuator 22 is biased toward the position shown in FIG. 2 by coil spring 40 extending between the actuator and motor 12. For this purpose one end of spring 40 may be anchored in actuator 22 and the other end placed on lip 42 of motor 12.

Throttle lever 44 is pivotally mounted on motor 12 by bolt 46 for movement by cable 48 connected to the operator actuated throttle control for motor 12. Cam follower 50 rides on the throttle lever 44 and is connected to shaft 52 of the carburetor to open and close the throttle valve of the carburetor venturi responsive to arcuate movement of the throttle lever. Throttle lever 44 includes projection 54 in the lower portions thereof.

FIG. 1 shows the device of the present invention with outboard motor 12 in neutral gear. When shaft 10 is positioned so as to place outboard motor 12 in neutral, cam 14 rides up on rise 32 of arm 28 of recoil starter lock actuator 22 to rotate the actuator counterclockwise when viewed as in FIG. 1. The counterclockwise movement of recoil starter limit actuator 22 moves link rod 30 to release the recoil starter lock, since the engine is in neutral. Releasing the starter lock permits the starter to be operated to start the engine by pulling the starter cord.

The counterclockwise movement of recoil starter limit actuator 22 also raises stop member 38 on arm 28. As control cable 48 is operated to rotate throttle lever 44 in the clockwise direction to open the throttle valve of the carburetor, projection 54 of the throttle lever 44 will strike stop member 38 after a predetermined amount of rotation of the throttle lever, as shown in phantom in FIG. 1. This limits the amount by which the throttle valve can be opened when outboard motor 12 is in neutral to avoid overspeeding the engine.

FIG. 2 shows the operation of the device of the present invention when shaft 10 has been moved to one of the forward or reverse drive positions by rod 16 and cam 14. Cam 14 has moved so that it engages one of the falls, for example, fall 34 of actuator arm 28. This causes recoil starter limit actuator 22 to rotate clockwise under the bias force provided by spring 40. This movement of the actuator moves link rod 30 so that the rod engages the starter lock to prevent operation of the starter with the motor in the forward or reverse drive condition.

The clockwise movement of recoil starter limit actuator 22 also lowers stop member 38 on arm 28. This permits throttle lever 44 to rotate freely to open and close the throttle valve of outboard motor 12, as desired by the operator.

When shaft 10 is moved to the other drive condition, cam 14 will engage fall 36. This places the recoil starter lock actuator 22 in a condition similar to that shown in FIG. 2, rendering the recoil starter lock effective and permitting free operation of throttle lever 44.

Various modes of carrying out the invention are contemplated as being within the scope of the following claims particularly pointing out and distinctly claiming the subject matter which is regarded as the invention.

I claim:

1. In a marine drive having a rotatable shaft operable between neutral and drive positions, a throttle control means for opening and closing the throttle valve of the marine drive, and a recoil starter lock, an improved means for releasing the starter lock and limiting throttle opening when the shaft is in the neutral position, said means comprising:

a cam mounted on said shaft for movement therewith, said cam being mounted normal to the axis of rotation of the shaft;

a recoil starter lock actuator member coacting with said cam and pivotally movable about a pivot point by the movement of said cam between the neutral and drive positions, said recoil starter lock actuator member having a generally L-shaped configuration with a pair of angularly displaced arms extending outwardly from said pivot point, a first of said arms being coupled to said recoil starter lock for releasing the lock when the shaft and said cam and actuator member are in the neutral position, the second of said arms having a rise and fall configuration for moving said actuator means by coaction with said cam, one of said arms having a stop thereon; and a stop on the throttle control means engaging said stop on said actuator member when the shaft and said cam and actuator member are in the neutral position for limiting the amount by which the throttle valve of the marine drive can be opened when the shaft is in the neutral position.

2. The improved means according to claim 1 including bias member for biasing said actuator means against said cam.

3. The improved means according to claim 1 wherein said cam is couplable to operator controlled gear selection means for rotating the shaft.

4. The improved means of claim 1 wherein said stop is formed on said second of said arms.

5. The improved means according to claim 1 wherein said first arm is shorter than said second arm.

* * * * *